United States Patent [19]

Berger

[11] 4,347,956

[45] Sep. 7, 1982

[54] HEARING AID SHEATH AND BODY HARNESS

[76] Inventor: Rosemary K. Berger, Apt. C-2, 29511 E. Jefferson, St. Clair Shores, Mich. 48081

[21] Appl. No.: 226,465

[22] Filed: Jan. 19, 1981

[51] Int. Cl.[3] ..... A45C 11/00

[52] U.S. Cl. ..... 224/202; 150/52 J; 150/52 R; 224/257

[58] Field of Search ..... 224/257, 202, 204, 205, 224/208, 257, 258, 908, 242; 150/0.5, 52 R, 52 J

[56] References Cited

U.S. PATENT DOCUMENTS

| | | | |
|---|---|---|---|
| D. 156,685 | 12/1949 | Weiss | 150/52 J |
| 1,925,694 | 9/1933 | Hawkins | 150/52 J |
| 2,351,675 | 6/1944 | Gengler | 224/258 X |
| 3,314,464 | 4/1967 | Veilleux | 150/52 R |
| 3,482,748 | 12/1969 | Roberts, Jr. | 224/208 |
| 3,813,017 | 5/1974 | Dimsleur | 150/52 J X |

*Primary Examiner*—Steven M. Pollard

*Attorney, Agent, or Firm*—Barnes, Kisselle, Raisch & Choate

[57] ABSTRACT

A holder and harness for an auditory trainer for children with impairment of hearing which includes a leather or plastic compartment case fashioned from a blank of sheet material with double panel bottom and back wall and flaps extending from the top and bottom of the front wall to overlap releasably at the back of the case to close the case. A body strap secures the back wall to the chest of the wearer while a neck strap loops from the end of the bottom flap to provide vertical support.

5 Claims, 9 Drawing Figures

HEARING AIR SHEATH AND BODY HARNESS

FIELD OF INVENTION

The protection of highly sophisticated hearing amplification devices used as educational aids for children with impaired hearing.

BACKGROUND OF INVENTION

In recent years, the detection of hearing impairment in children has been greatly improved and children with this difficulty are being assisted at very early ages to overcome and cope with their particular problems. Electronic advances have resulted in transistorized hearing aids (F-M auditory training units) for use by very young children in order that their development can proceed along reasonably normal lines. The ability to hear through the electronic devices enables speech and language to develop more fully and allows the children to be mainstreamed in a regular classroom setting and tuned in on the teacher.

The aid devices to permit this development are, however, very expensive, ranging in price from $600.00 to $1,000.00 or more depending on the particular make of the trainer (aid). The aid involves the use of receiving sets which utilize crystals which must be changed by the child as he or she visits different classrooms or areas in the school facility. These crystals isolate selected wave lengths in the transmission. In most cases the child learns to change these crystals himself; but because of this need for change, the crystal must be accessible to the child. The aids are worn throughout the school day during lunch, outdoor play, gymnasium, physical education, etc.

It is an object of the present invention to provide a protective cover for a hearing aid of the nature described which permits access to the controls and to the crystals while providing cover against shock and any spilling of food or liquid. The aid must be worn on the chest of the user where it is in the best position for reception as well as to permit the corded hearing receiver and earmold to be in place in the child's ear.

In addition, with active children, the aid must be secured to the body to prevent it from banging against the wearer who is moving about as healthy active children are want to do.

Thus, the present invention is directed to a hearing aid case which can be readily manipulated by children as young as three years of age and which is secured to the body in such a manner that the child may run and play without hurting himself and damaging the protected device or affecting the functions for which it is intended.

Other objects and features of the invention relating to details of construction and operation will be apparent in the following specification and claims in which the invention is described and the manner and process of making and using it are set forth for persons skilled in the art all in connection with the best mode presently contemplated for the practice of the invention.

BRIEF DESCRIPTION OF THE DRAWINGS

Drawings accompany the disclosure and the various views thereof may be briefly described as.

DETAILED DESCRIPTION OF THE INVENTION AND THE MANNER AND PROCESS OF USING IT

Figure 1:
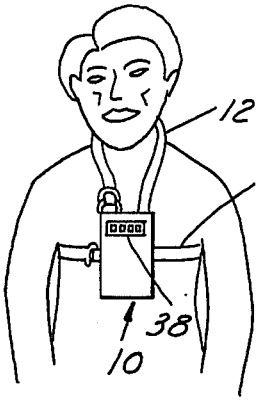
FIG. 1, a frontal view of a child wearing the aid holder.

With reference to the drawings, in FIG. 1 the aid holder 10 is shown worn by a child on the chest area with a neck strap 12 which passes around the back of the neck and a body strap 14 which passes behind the wearer. In FIG. 2*a*, the plan layout of the holder is shown. The lateral body portion has two opposed wings 20 and 22 each of which forms a side panel 24 and 26 respectively delineated by dot-dash lines. The remainder of the wings overlap to form a double back panel. The tabs 28 and 30 overlap as the sides are folded up to form the bottom of the holder. Between the wings 20 and 26 is the front panel 32 which is extended at the top to provide a top flap 34 and at the bottom to provide a back support flap 36.

The front panel 32 preferably has a slot 38 or other apertures to expose certain functional elements of the hearing aid such as the volume for the ear receivers, the signal selector and the microphone.

Figure 6:
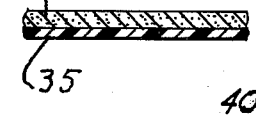
FIG. 6, a section of a padded fabric which may be used for the material of the holder.

The material used to make the holder may be any pliable, flexible, durable, and preferably waterproof, sheeting such as leather, or automotive vinyl used in the interior trim of vehicles. As shown in FIG. 6, it may have an outer layer 35 simulating leather and an inner layer 37 of padded material or foam padding to protect the unit from contact blows and secure it snugly as it is worn.

Figure 2:
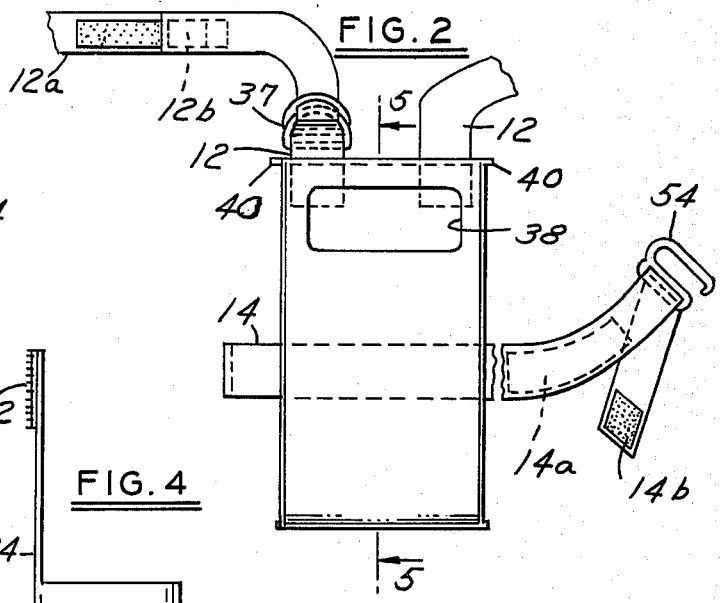
FIG. 2, an enlarged front view of the holder.
Figure 3:
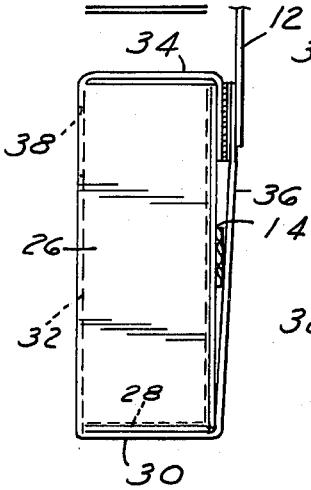
FIG. 3, a side view of the holder with cover flaps closed.
Figure 4:
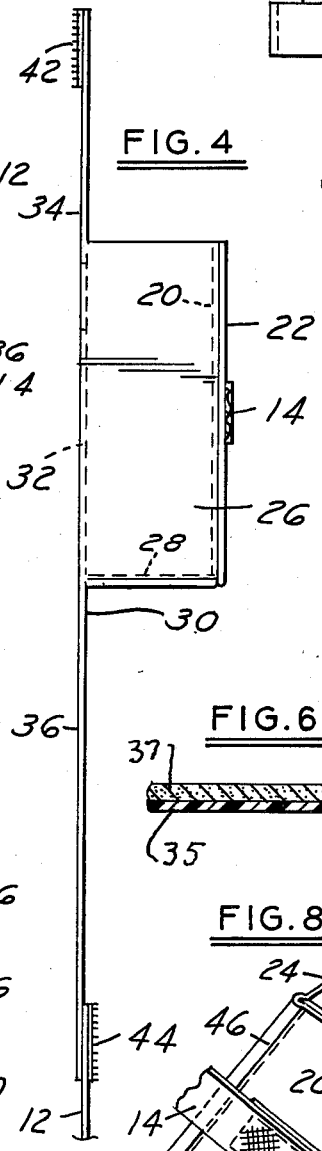
FIG. 4, a side view of the holder with cover flaps open.
Figure 5:
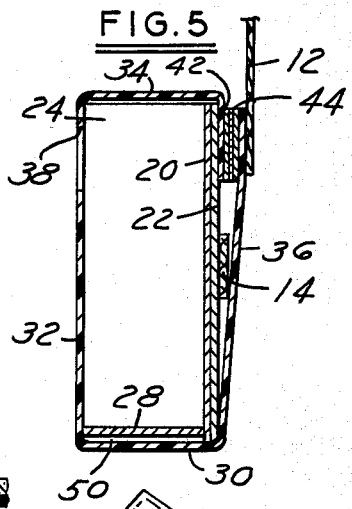
FIG. 5, a sectional view on line 5—5 of FIG. 2.
Figure 2A:
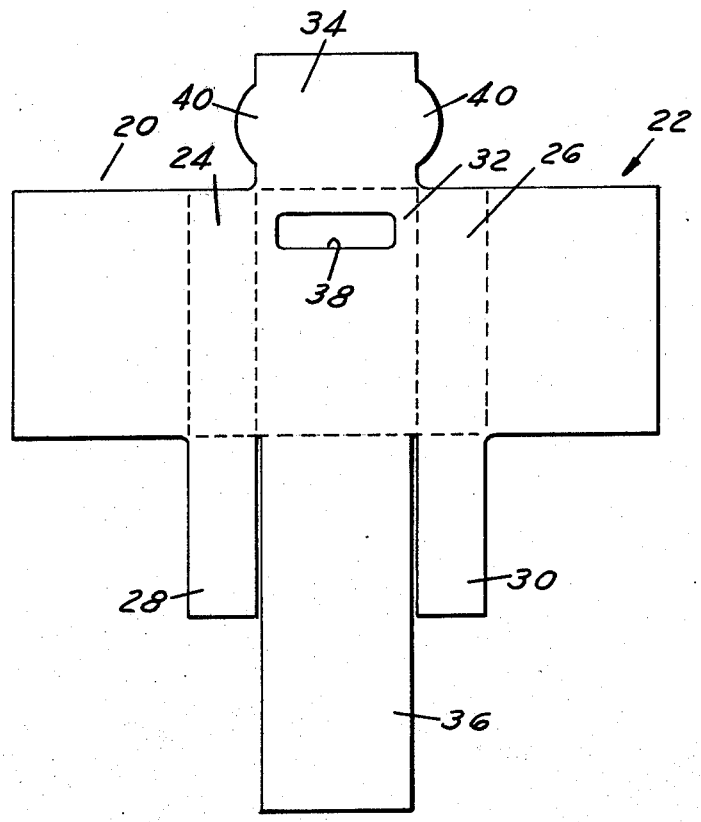
FIG. 2A, a layout of the holder before assembly.

As viewed in FIG. 5, a section on line 5—5 of FIG. 2, the front panel 32 is shown at the left and the bottom is formed of the overlapped tabs 28 and 30. The back is formed by the overlapped wings 20 and 22 which have been brought forward and around to form the sides and back. The top flap 34 has two ears 40 extending from its sides. As viewed in FIG. 5, the top flap or closure 34 has a Velcro (T.M.) strip 42 on its outer surface.

The bottom flap 36 folds under the double ply bottom 28–30 and up along the back panel 20–22. It also has a Velcro (T.M.) strip 44 which interlocks with the strip 42.

Figure 8:
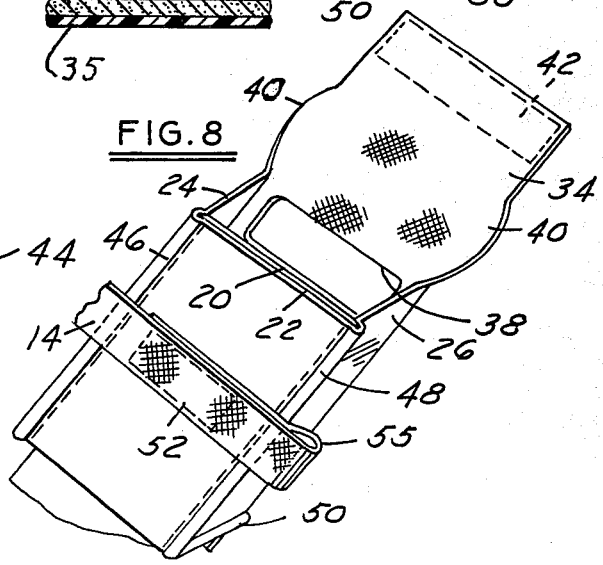
FIG. 8, a perspective view of the device with the cover open.

The back vertical corners of the device are stitched as at 46 and 48 to join the two overlapped wings 20–22 together (FIG. 8). Also, the bottom overlaps 28 and 30 are sewn at the seams 50.

The neck strap 12 is fastened to each corner of the end of the back flap 36, but the strap 12 loops through two D-rings and back on itself with adjustable Velcro (T.M.) connector pads 12*a* and 12*b* to allow lengthening of the strap to accommodate the growth of the child or varying bulk of clothing worn. Similarly, the body strap 14 is stitched at 52 (FIG. 8) to the double back panel 20–22 and has a hook buckle end 54 which cooperates with a loop 55 (FIG. 8) to hold the unit close to the body so it will not flap or bounce when the child is moving. But the strap 14 also loops through the hook buckle 54 and doubles back upon itself with Velcro (T.M.) pads 14*a*, 14*b* to permit adjustment as needed.

Figure 7:
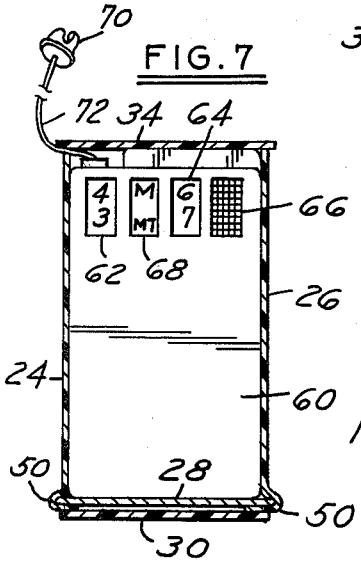
FIG. 7, a cut-away view showing a hearing aid in place.

The aid itself is contained in the holder as shown at 60 in the view in FIG. 7 which is sectioned to eliminate the front panel 32. The aid may have two volume controls 62 and 64 for each earphone, if two are used, and a microphone aperture 66. Switch 68 [MT or M] is a signal selector which enables the child to listen only to environmental noise (M) or predominately to what is coming over the transmitter (teacher's mike) as well as environmental noise (MT). These functional devices are accessible through the opening 38. Most devices of this kind have a crystal on the top which is changeable for each transmitter being used. Since the wearer must change the crystals himself, the top flap 34 can be opened by unlocking the Velcro (T.M.) latch section without disturbing the neck or body straps.

The top flap has the tab extensions or ears 40–40 to overlie the sides to protect the instrument. Since the children wear these devices during mealtime, it is important that the flap cover the instrument at the top to protect the crystal and keep food out of the unit. The design is such that the double back panel forms a pad against the body and a protection for the aid; and the double bottom provides a secure support for the hearing aids. The transducers and earmolds 70 are attached to a lead wire 72 which is attached at the top of the unit. On some models, they are attached at the side of the unit.

Children at a very early age can don the device by slipping their head through the loop of the neck strap and fastening the body strap. They can readily manage the Velcro (T.M.) lock so they can install and exchange crystals for each transmitter used. They can run and play and live quite normal lives while wearing the units.

What I claim is:

1. A holder for F-M auditory training units for children with severe hearing impairment which comprises:

(a) a case formed from a single sheet of pliable material having a body and lateral wings folded to form the front panel, side panels, and overlapping to form the rear panel of the case, (b) top and bottom flaps extending from the body to overlap releasably at the body side of the wearer behind the rear panel, (c) bottom tabs parallel to the bottom flap overlapping in assembly to form the bottom of the case, and (d) support straps encircling the body and the neck of the wearer secured to the case to confine it to the chest area of a wearer.

2. A holder as defined in claim 1 in which the body strap is secured to the rear of the case and the neck strap is a loop secured at each end to the end of the bottom flap as it passes upwardly behind the rear panel.

3. A holder as defined in claim 2 in which the the body strap and the neck strap is each looped back upon itself at one end and connected by Velcro fasteners to permit adjustment of the straps to accommodate growth of the child and to adjust to bulky clothing.

4. A holder for F-M auditory trainers used for children with hearing impairment which comprises:

(a) a case of pliable material having a front panel, side panels, a bottom panel, and a back panel, the back panel being formed by first overlapping extensions of the side panels, the bottom panel being formed by overlapping second extensions of said side panels extending in a direction perpendicular to the first overlapping extensions, (b) a top flap extending upwardly from the front panel and foldable over a portion of the back panel, (c) a bottom flap extending downwardly from the front panel and foldable up over a portion of the back panel to releasably engage said top flap, (d) a body strap secured to said back panel to releasably encircle the body of the wearer, and (e) a neck strap with ends secured to the end of the upwardly extending bottom flap to support the case on the chest of the wearer.

5. A holder for F-M auditory trainers used for children with hearing impairment which comprises:

(a) a case of pliable material having a front panel, side panels, a bottom panel, and a back panel, (b) a top flap extending upwardly from the front panel and foldable over a portion of the back panel, (c) a bottom flap extending downwardly from the front panel and foldable up over a portion of the back panel to releasably engage said top flap, (d) a body strap secured to said back panel to releasably encircle the body of the wearer, (e) a neck strap with ends secured to the end of the upwardly extending bottom flap to support the case on the chest of the wearer, and (f) said top flap having side tab extensions to extend over the top edges of said side panels to protect the inside of the holder from food particles when worn by the wearer while eating.

* * * * *